United States Patent [19]

Cornia

[11] 4,357,845

[45] Nov. 9, 1982

[54] APPARATUS FOR MANIPULATING WINGNUTS

[76] Inventor: Jared B. Cornia, 4065 E. University, Space #224, Mesa, Ariz. 85205

[21] Appl. No.: 193,806

[22] Filed: Oct. 3, 1980

[51] Int. Cl.[3] ..... B25B 13/02

[52] U.S. Cl. ..... 81/125; 81/90 D

[58] Field of Search ..... 81/90 D, 121 A, 125

[56] References Cited

U.S. PATENT DOCUMENTS

| | | | |
|---|---|---|---|
| 2,445,905 | 7/1948 | Busby | 81/90 D X |
| 2,642,105 | 6/1953 | Alliano | 81/121 A |
| 2,660,080 | 11/1953 | DeKam | 81/125 UX |
| 2,940,344 | 6/1960 | Taylor | 81/90 D |
| 3,086,414 | 4/1963 | Nardi | 81/90 D |
| 3,253,626 | 5/1966 | Stillwagon et al. | 81/125 X |

*Primary Examiner*—James G. Smith

*Attorney, Agent, or Firm*—Harry M. Weiss

[57] ABSTRACT

A universal wingnut wrench, which incorporates a grip apparatus capable of engaging various wingnut configurations, a drive apparatus adapted to be driven manually or by any of a variety of implements, and an integral magnet to adhere a wingnut to the wrench, to serve in combination as a device to facilitate the installation and removal of wingnuts from even marginally accessible locations is provided.

2 Claims, 10 Drawing Figures

APPARATUS FOR MANIPULATING WINGNUTS

BACKGROUND OF THE INVENTION

1. Field of the Invention

This invention relates generally to wrenches, and more specifically, to a universal wingnut wrench adapted to permit wingnuts to be installed and removed under difficult conditions, including installation on or removal from over-length studs, or installation or removal where access to the stud is very limited.

2. Description of the Prior Art

In the past, wingnuts have been extensively utilized in conjunction with various threaded members, such as bolts or studs, to serve as fasteners. While wingnuts are inherently provided with ears to permit manual installation and removal from the threaded members, it was often difficult to apply sufficient torque by hand to either tighten the wingnut to the desired degree, or to remove a wingnut which had been overtightened. Overtightening often occurred, for example, where the installer had used pliers, or a screwdriver wedged between an ear of the wingnut and the body of the wingnut, to apply substantial torque to the wingnut. Another example of such an overtightened condition occurred where the wingnut was used to fasten a wooden object such as a box, which object subsequently absorbed sufficient water to expand, and therby apply added load to the wingnut. A need existed for a wingnut wrench which could apply greater torque to the wingnut than was possible to apply by hand alone.

A typical application involving wingnuts, such as fastening together the various components of a display for shipment, often required that various sizes of studs and wingnuts be utilized. Typically, the wingnuts also had different ear spans and thicknesses. A need existed for a wingnut wrench capable of effectively engaging various sizes of wingnuts.

Often, wingnuts were required to be installed in locations having extremely limited access. Since the wingnut had to be exactly aligned with the axis of the stud to permit the threads to properly engage one another, a need existed for a wingnut wrench capable of maintaining a wingnut in a particular axial alignment even where the stud was not fully accessible by hand.

Various attempts were made in the past to solve these problems. A typical example of such attempts is illustrated by U.S. Pat. No. 3,071,995, issued on Jan. 8, 1963 to W. E. Ruthrauff, for a Tool for Fasteners. While the device disclosed by that patent did provide for engaging a wingnut to permit greater torque to be applied than would be possible by hand, its construction was suited to use with only a single size of wingnut. The Ruthrauff device also made no provision for maintaining the wingnut in axial alignment for installation in marginally accessible locations.

Another example of an attempt to provide a solution to the previously outlined problems is illustrated by U.S. Pat. No. 3,086,414 issued on Mar. 1, 1961 to G. Nardi for a Combination Wrench. That device also allowed additional torque to be applied to a wingnut, but again made no provision for use on wingnuts of varying sizes, nor did it provide for keeping the wingnut in communication with the wrench to allow axial alignment to be acheived in difficult access situations.

A need continued to exist for a universal wingnut wrench compatible with various sizes of wingnuts, which was also capable of maintaining the axial alignment of the wingnut to permit installation in relatively inaccessible locations.

SUMMARY OF THE INVENTION

In accordance with one embodiment of this invention, it is an object to provide a universal wingnut wrench.

It is a further object to provide a wingnut wrench adapted to drive more than one size or type of wingnut.

It is another object to provide a wingnut wrench capable of maintaining the axial alignment of a wingnut, at least against the force of gravity.

It is a further object to provide a wingnut wrench which can be driven by a screwdriver.

It is yet another object to provide a wingnut wrench which can be driven by either a screwdriver or a socket-type wrench.

DESCRIPTION OF THE PREFERRED EMBODIMENTS

In accordance with one embodiment of this invention, a universal wingnut wrench is disclosed, comprising: a body member having grip means for engaging the ears of a wingnut; magnet means for magnetically adhering the wingnut to the body member; and drive means for permitting torque to be applied to the body member so that the wingnut can be rotated with the wrench.

In accordance with another embodiment of this invention, a method of controllable installing and removing a wingnut is disclosed, comprising the steps of: providing a u-shaped magnet; engaging the ears of the wingnut between the legs of the magnet; and rotating the magnet.

The foregoing and other objects, features and advantages of this invention will be apparent from the following more particular descripton of the preferred embodiments of the invention as illustrated in the accompanying drawings.

Figure 1:
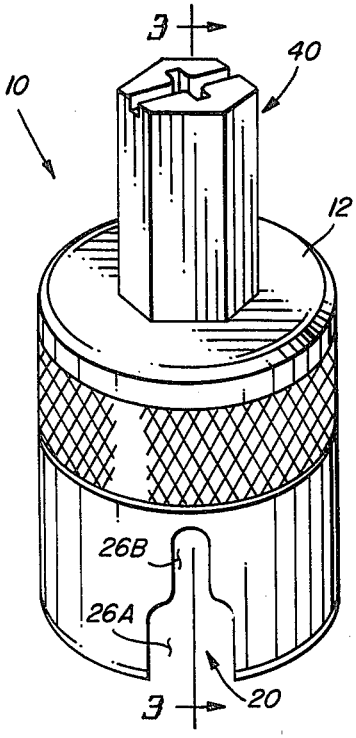
FIG. 1 is a perspective view of an end of a first embodiment of a universal wingnut wrench.

Referring to FIG. 1, a universal wingnut wrench is shown generally by reference number 10. The wrench 10 is essentially provided with a body member 12 which has grip means shown generally by reference number 20, magnet means, and drive means as shown generally by reference number 40. The grip means 20 are for engaging the ears of a wingnut (refer to FIGS. 5 through 8). The magnet means are for magnetically adhering the wingnut to the body member 12. The drive means 40 are for permitting torque to be applied to the body member 12 so that the wingnut can be rotated with the wrench 10.

Figure 2:
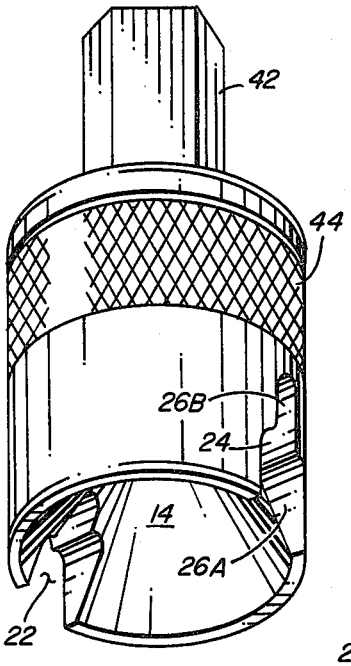
FIG. 2 is a perspective view of another end of the first embodiment of a universal wingnut wrench.

Referring also to FIG. 2, a perspective view of the first end region of the wrench 10 is shown. The grip means 20 are shown as being comprised of first and second slots 22, 24 at the first end of the body member 12. The body member 12 has an internal aperture 14 (refer also to FIG. 3) at the first end to pemit the wrench 10 to slip over a long projecting stud or bolt to permit the installation and removal of the wingnut.

The magnet means are particularly advantageous for magnetically coupling or adhering a wingnut to the wrench 10. Thus, the wingnut can be maintained in drivable communication with the slots 22, 24, and, hence in axial alignment with the wrench 10 itself, even when gravitational forces would tend to remove the wingnut from such engagement. This feature is of particular value for those applications where a wingnut must be installed in relatively inaccessible locations, such as at the bottom of a hole or other concavity. In a preferred embodiment 10, the magnet means are comprised of the body member 12 having substantial residual magnetism. In essence, the body member 12 acts as a horseshoe magnet, with the respective magnetic poles located at the first end on opposite sides of the plane formed by the first and second slots 22, 24. In this manner, the strongest magnetic field exists between the adjacent portions of the body member 12 separated by the respective slots 22, 24. Thus, when a conventional highly paramagnetic wingnut is engaged by the slots 22, 24, it is also retained, at least sufficiently to counteract gravitational forces, by the magnet means.

The drive means 40, which permit torque to be applied to the wrench 10 so that a wingnut can be rotated, are comprised of a shank 42 which is coupled to a second end of the body member 12. In the preferred embodiment 10, the shank member 42 is provided with a hexagonal external surface, symmetrically disposed about the longitudinal axis of the wrench 10 so that the conventional box, open or socket type wrenches can be used to turn the wingnut wrench 10. The body member 12 is also provided with an external knurled surface 44, which permits the wrench 10, and hence the wingnut, to be directly driven by hand. The knurled drive surface 44 is particularly valuable in those applications where only available access to the wingnut is so limited that the full hand and wrist rotation normally required to rotate a wingnut is not possible. The knurled surface 44 permits incremental rotation of the wingnut with simple finger manipulation without requiring a full rotation of the hand to permit torque to be applied to the diametrically opposed ears of the wingnut.

Figure 3:
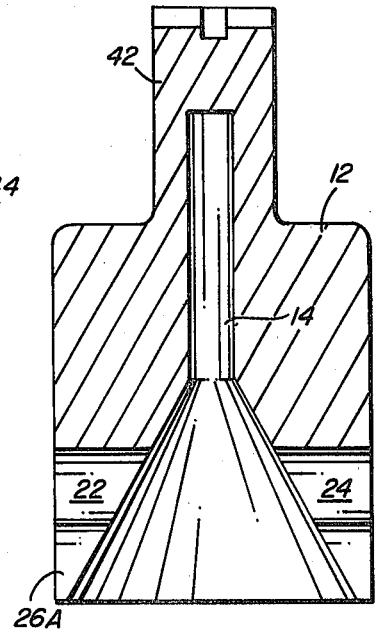
FIG. 3 is a sectional view taken along line 3—3 of FIG. 1.

Referring then to FIG. 3, a sectional elevational view taken along line 3—3 of FIG. 1 is shown. The length of aperture 14, which permits the wrench 10 to be used to install wingnuts on, or remove wingnuts from, long studs or bolts, is clearly shown.

Figure 4:
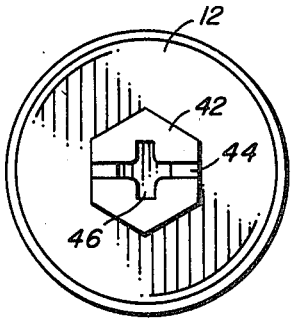
FIG. 4 is a top view of the driven end of the universal wingnut wrench.

FIG. 4 is a view of the second end of the wrench 10. The drive means 40 are shown as being further comprised of the shank 42 having first and second slots 44, 46. The slots 44, 46 are orthogonally disposed so that torque can be applied to the shank 42 with either a blade-type screwdriver or a Phillip's-type screwdriver.

Figure 5:
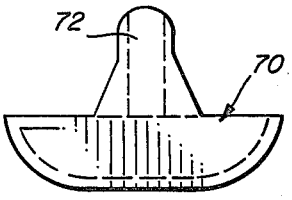
FIG. 5 is an elevational view of a conventional stamped-type wingnut.
Figure 6:
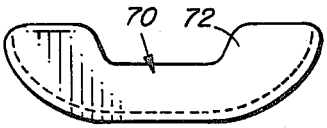
FIG. 6 is another elevational view of a conventional stamped-type wingnut.

Referring to FIGS. 5 and 6, a wingnut of typical stamped steel construction is shown by reference number 70. The stamped steel wingnut 70 has ears, or wings, 72 of a substantial width. A first portion 26A (Refer to FIG. 1) of each of the slots 22, 24 is particularly adapted to engage such a wingnut 70 having ears 72 as shown.

Figure 7:
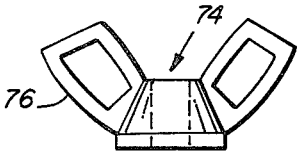
FIG. 7 is an elevational view of a conventional cast or forged type wingnut.
Figure 8:
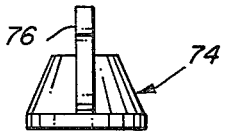
FIG. 8 is another elevational view of a conventional cast or forged type wingnut.

Referring then to FIGS. 7 and 8, the structure of a typical wingnut of cast, or forged, construction as shown generally by reference number 74. The cast wingnut 74 is provided with ears 76, which ears are of substantially less thickness than corresponding ears of a stamped-from-sheet wingnuts 70, as clearly shown by a comparison between FIGS. 5 and 8. A second portion 26B (refer to FIG. 1) of each of the slots 22, 24 is particularly adopted to engage such a wingnut 74 having ears 76 as shown.

Figure 9:
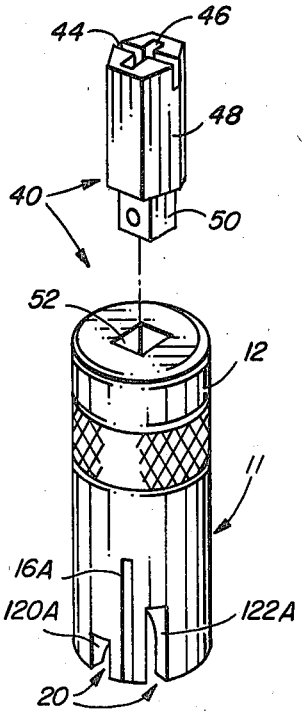
FIG. 9 is a perspective view of a second embodiment of a universal wingnut wrench.

Referring then to FIG. 9, a second embodiment of a wingnut wrench is shown generally by reference number 11. Features held in common by first and second embodiments 10, 11 are shown by similar reference numbers. The wrench 11 is provided with the body member 12 having the grip means shown generally by reference number 20, magnet means and the drive means shown generally by reference number 40. In the second embodiment 11, the magnet means are also comprised of the body member 12 having first and second opposed permanent magnetic poles. While the magnetic poles of the second embodiment 11 are also located at the first end of the body member 12, the poles are symmetrically disposed about and separated by a pair of magnetically impermeable, or diamagnetic, regions, a first of which is shown by reference number 16A.

The drive means 40 of the second embodiment 11 are comprised of a separate shaft member 48 which has a projecting drive lug 50 disposed to drivably engage an aperture 52 in the second end of the body member 12. The shaft 48 is also provided with a hexagonal exterior surface, and the orthogonal slots 44, 46, to facilitate driving the wrench 11 with conventional hand tools.

Figure 10:
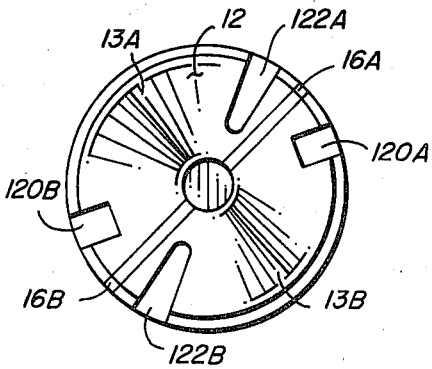
FIG. 10 is a view of the driving end of the second embodiment of a universal wingnut wrench.

Referring then to FIG. 10, an enlarged view of the first end of the second embodiment 11 of the wingnut wrench is shown. The body member 12 is shown having the first and second magnetic pole regions 13A, 13B separated by the internal aperture 14 and the first and second diamagnetic regions 16A, 16B. The diamagnetic regions 16A, 16B are radially disposed about the axis of the aperture 14. The individual ones of the first pair of slots 120 are respectively shown by reference numbers 120A, 120B. The individual ones of the second pair of slots 112 are individually shown by reference numbers 122A, 122B. To permit the magnet means to adhere a wingnut to the body member 12, the respective individual ones of the first and second pairs of slots 120, 122 are respectively each positioned immediately adjacent one of the diamagnetic regions 16A, 16B within opposed ones of the magnetic pole regions 13A, 13B. In this manner, a stamped-from-sheet wingnut 70 or a cast wingnut 74, either of which is typically highly paramagnetic, can be respectively engaged in the first pair of slots 120 or the second pair of slots 122. It can be seen that the respective pairs of slots 120, 122 of the wrench 11 can be respectively sized to securely engage two totally different wingnut configurations, while pemitting either configuration to be magnetically coupled to the wrench 11.

While the invention has been particularly described and shown in reference to the preferred embodiments thereof, it will be understood by those skilled in the art that various changes in form and detail and omissions may be made therein without departing from the spirit and scope of the invention.

What is claimed is:

1. A universal wingnut wrench comprising:

a body member having grip means for engaging the ears of a wingnut;

magnet means for magnetically adhering said wingnut to said body member; and drive means for permitting torque to be applied to said body member so that said wingnut can be rotated with said wrench, said magnet means comprising:

said body member having opposed positive and negative magnetic pole regions;

said magnetic pole regions having symmetry about a longitudinal plane of said body member;

said body member having a concavity at a first end; and said body member further comprising first and second and magnetically impermeable regions interposed between said pole regions adjacent said first end, said grip means comprising:

said body member having first and second pairs of diametrically opposed pairs of slots at said first end;

said body member having a first of each of said pairs of slots in said positive region adjacent a different one of said impermeable regions; and said body member further having a second of each of said pairs of slots in said negative region adjacent a different one of said impermeable regions.

2. A universal wingnut wrench in accordance with claim 1 wherein said drive means comprising:

said body member having a drive aperture at a second end;

said drive aperture of said body member having corners; and a removable hexagonal shaft member disposed to drivably engage said drive aperture.

* * * * *